US005363875A

United States Patent [19]

Vollmer

[11] Patent Number: 5,363,875

[45] Date of Patent: Nov. 15, 1994

[54] HYDRAULIC DISCONNECTOR

[75] Inventor: Rudolf Vollmer, Mosbach, Germany

[73] Assignee: Honeywell Inc., Minneapolis, Minn.

[21] Appl. No.: 16,640

[22] Filed: Feb. 12, 1993

[30] Foreign Application Priority Data

Feb. 14, 1992 [DE] Germany ..... 4204386

[51] Int. Cl.[5] ..... E03C 1/10

[52] U.S. Cl. ..... 137/218; 137/107

[58] Field of Search ..... 137/107, 218

[56] References Cited

U.S. PATENT DOCUMENTS

| | | | |
|---|---|---|---|
| 4,090,527 | 5/1978 | Sutherland | 137/218 X |
| 4,232,704 | 11/1980 | Becker et al. | 137/218 |
| 4,478,236 | 10/1984 | Neuzeret et al. | 137/218 X |
| 4,573,491 | 3/1986 | Arens et al. | 137/218 |
| 4,745,946 | 5/1988 | Kern | 137/488 X |
| 4,895,180 | 1/1990 | Vollmer | 137/218 X |

FOREIGN PATENT DOCUMENTS 3247325 7/1985 Germany .

*Primary Examiner*—Gerald A. Michalsky
*Attorney, Agent, or Firm*—Edward L. Schwarz

[57] ABSTRACT

A flow disconnector has an intermediate chamber connected between inlet and outlet check valves. A diaphragm controls a venting valve for the intermediate chamber which is designed to empty the intermediate chamber when the difference between inlet pressure and intermediate chamber pressure becomes too small. To prevent unnecessary emptying of the intermediate chamber, a pressure stabilizer is connected between the inlet and the intermediate chamber. The stabilizer holds the pressure in the intermediate chamber below the inlet pressure by an amount sufficient to prevent unnecessary emptying of the intermediate chamber.

13 Claims, 2 Drawing Sheets

HYDRAULIC DISCONNECTOR

BACKGROUND OF THE INVENTION

The present invention relates to a disconnector which serves as a safety device to be inserted in a drinking water supply pipe to prevent backflow from a downstream point in the piping. In certain systems, the potable water supplied by the pipe may discharge into a contaminated container, and if for some reason that water is forced back upstream, can contaminate water supplied by the source of the drinking water. It is customary to use a check valve to prevent this backflow, but since a small amount of downstream water can pass through a check valve in the upstream direction whenever downstream pressure exceeds upstream pressure, there is a possibility for contamination.

To prevent this occurrence, disconnectors are now used which have two check valves or backflow preventers each having an input port and an output port. An intermediate chamber is connected to the output port of the first check valve and the input port of the second check valve so as to place the check valves in series connection. The input port of the first check valve serves as the input port for the disconnector and the output port of the second check valve serves as the output port of the disconnector. The intermediate chamber has a venting or drain valve controlled by differential pressure between the input port of the first check valve and the intermediate chamber. The venting valve drains the intermediate chamber when the differential pressure between the disconnector's input port and the intermediate chamber falls below a certain value to thereby prevent a backflow from the output side to the input side and potentially contaminate the source. Such a disconnector is disclosed in U.S. Pat. No. 4,478,236.

There is however, a disadvantage in such a disconnector in that at zero flow, normal fluctuations of the pressure at the input port of the disconnector will reduce the pressure differential to a point which causes the venting valve to drain the intermediate chamber. This is inconvenient for two reasons. On the one hand the water in the intermediate chamber is wasted. On the other hand such a water loss delays flow of water through a tap operated thereafter by a user, and may be interpreted as a malfunction by a user unfamiliar with the operation of such a disconnector.

BRIEF DESCRIPTION OF THE INVENTION

It is the object of the present invention to improve such known disconnectors to prevent water loss from the intermediate chamber without affecting performance of its safety function.

It is possible to avoid most occurrences of unnecessary draining of the intermediate chamber in such prior art disconnectors by controlling the pressure within the intermediate chamber to be always below the inlet pressure by a predetermined amount. This can be accomplished by connecting a differential pressure stabilizer between the input port and the intermediate chamber. Such a differential pressure stabilizer comprises a housing enclosing first and second chambers separated by a first stabilizer wall movable in first and second directions to respectively enlarge and shrink the first chamber and through which the first and second chambers are in pressure communication. The pressure stabilizer's first and second chambers are respectively in flow communication with the input port and the intermediate chamber.

In a preferred embodiment, the venting valve includes means sensing the pressure differential between the input port and the intermediate chamber, for venting the intermediate chamber when said pressure differential falls below a predetermined pressure differential value. The differential pressure stabilizer includes means for holding the pressure in the intermediate chamber to less than the difference between the inlet pressure and the predetermined pressure differential value.

A preferred differential pressure stabilizer comprises a housing enclosing first and second chambers separated by a first stabilizer wall movable in first and second directions to respectively enlarge and shrink the first chamber and through which the first and second chambers are in pressure communication. The first and second chambers are in flow communication respectively with the input port and the intermediate chamber. A bias means is in operative connection with the first stabilizer wall to apply force to the first stabilizer wall urging the first stabilizer wall in the second direction. The force applied by the bias means forms the equivalent of a pressure differential across the first stabilizer wall greater than the predetermined pressure differential value.

DESCRIPTION OF THE PREFERRED EMBODIMENT

Figure 1:
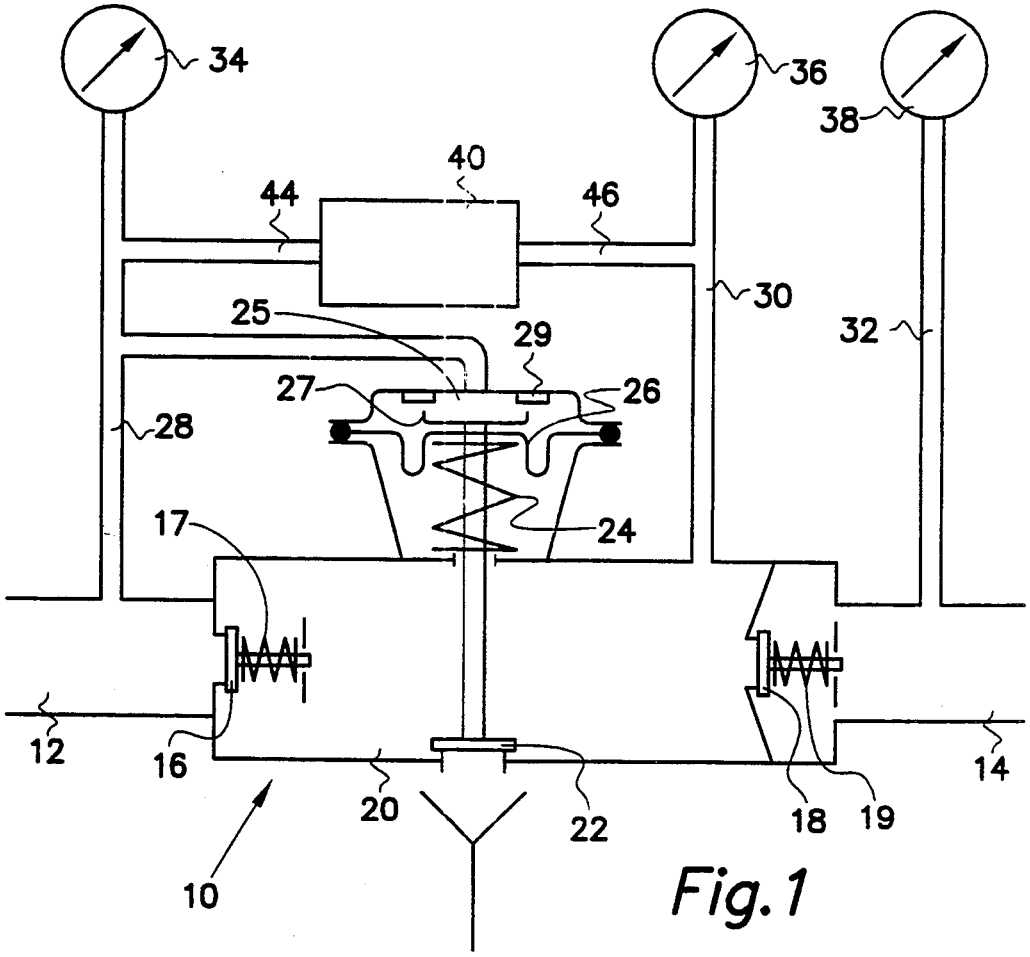
FIG. 1 shows a prior an disconnector modified according to the invention with a differential pressure stabilizer connected between the input port of the disconnector and the disconnector's intermediate chamber.

A disconnector 10 is shown in FIG. 1 as comprising first and second backflow preventers or check valves 16 and 18 each having an inlet port and an outlet port. The inlet port of check valve 16 serves as the inlet 12 for the disconnector 10, and the outlet port of check valve 18 serves as the outlet 14 for the disconnector 10. An intermediate chamber 20 is in flow communication with the output port of valve 16 and the inlet port of valve 18 to thereby arrange valves 16 and 18 in series between inlet 12 and outlet 14 with chamber 20 between the valves 16 and 18. Check valves 16 and 18 respectively have compression closure springs 17 and 19 which hold the valves closed. Predetermined differential pressure levels across check valves 16 and 18 force the valves open against the force of the closure spring of each to allow flow. One can see that a pressure drop or differential must exist across each of the check valves 16 and 18 in order to hold it open during flow of water. When flow ceases, pressure rises downstream of each of the valves 16 and 18, and when a design closure pressure differential for each valve is reached, the valve closes. The typical check valve has a closure pressure differential slightly less than, but quite close to the opening pressure differential. In this design, check valve 16 typically has a relatively heavy closure spring 17 which requires a pressure differential across valve 16 greater than some predetermined value on the order of 0.3 to 0.7 bar (5 to 10 psi) to cause flow to occur, and some value slightly less than this predetermined value to close valve 16. On the other hand, a relatively light closure spring 19 creates predetermined opening and closing pressure differential levels for valve 18 which are an order of magnitude smaller than those for the opening of valve 18. In general, it is preferred to use the smallest pressure differentials possible for these check valves which still provide safe operation, so as to provide maximum pressure for the user drawing water downstream from outlet 14.

Chamber 20 can be drained or vented by means of a venting valve 22 located in the bottom of chamber 20. Opening and closing of valve 22 is controlled by a diaphragm 26 and a compression spring 24 which is operatively connected to diaphragm 26 to apply biasing force to diaphragm 26 which urges valve 22 to open. Diaphragm 26 is contained in a diaphragm housing and divides the interior of the housing into a first chamber 25 which is in flow communication with the inlet 12, and a second chamber in flow communication with chamber 20. One can thus see that the force generated by diaphragm 26 on valve 22 depends on the difference between the pressures in chambers 25 and 20. In order to hold valve 22 closed and avoid draining chamber 20, the pressure at the inlet 12 must be sufficiently greater than the pressure in the intermediate chamber 20 to overcome the force of spring 24. When the difference between inlet 12 pressure and chamber 22 pressure falls below a predetermined level, then spring 24 force on diaphragm 26 is sufficient to overcome the pressure force and vent the intermediate chamber 20 by opening the venting valve 22. The spring rate of spring 24 is typically on the order of 0.1 to 0.3 bar (1.5 to 4.5 psi). In any case, to prevent unwanted venting of the chamber 20, the spring 24 must have a spring rate creating a spring force on diaphragm 26 equivalent to a differential pressure on diaphragm 26 which is less than the opening pressure of check valve 16. While valve 22 is shown as controlled by diaphragm 26, in fact any movable wall within the diaphragm housing which divides the enclosed space into two chambers in pressure communication but not flow communication is suitable. An alternative to diaphragm 26 might be a piston sliding within a cylinder.

The pressure of the water or other fluid at the inlet 12, in the intermediate chamber 20 and at the outlet 14 may be shown on pressure gauges 34, 36 and 38 connected by means of pressure-tapping risers or studs 28, 30 and 32.

As explained earlier, normal fluctuations of the inlet 12 pressure will on occasion cause the pressure differential across diaphragm 26 to create force below the force generated on diaphragm 26 by spring 24. When this happens, the force from spring 24 is sufficient to cause valve 22 to open and chamber 20 to drain. According to the present invention a differential pressure stabilizer 40 is connected between inlet 12 and the intermediate chamber 20. The stabilizer 40 serves to hold the pressure within chamber 20 at a fixed differential value below the pressure within inlet 12. With the pressure within chamber 20 following but lower than that at inlet 12 by an amount which prevents spring 24 from forcing valve 20 to open, valve 22 remains closed and water in chamber 20 is not drained even when pressure at inlet 12 falls substantially. It is generally more convenient to integrate differential pressure stabilizer 40 into the housing of the disconnector 10, but is shown as separate for easier visualization.

Figure 2:
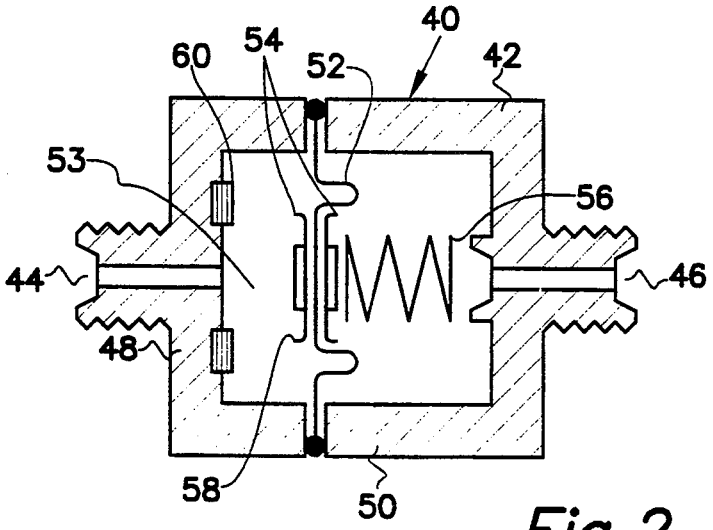
FIG. 2 shows the internal structure of a preferred differential pressure stabilizer.

The differential pressure stabilizer 40 is shown in FIG. 2 as comprising a cylindrical housing 42 which is provided at one side with an inlet 44 and on the other side with an outlet 46. Housing 42 comprises two segments 48 and 50 held together by means not shown, with a diaphragm 52 clamped between their edges. Segments 48 and 50 have respectively within their end walls, inlets 44 and 46. Diaphragm 52 comprises a stabilizer wall separating the space enclosed by housing 42 into first and second chambers 53 and 55 respectively. Diaphragm 52 is movable in first and second directions which respectively enlarge and reduce the volume of first chamber 53. Chambers 53 and 55 are in pressure communication with each other through diaphragm 52, and respectively in flow communication with inlet 12 through inlet 44 and intermediate chamber 20 through inlet 46 and the piping shown. The wall formed by diaphragm 52 may also comprise a bellows or a piston.

The central area of diaphragm 52 is clamped between two spring plates 54. A compression spring 52 is interposed between the spring plate 54 within second chamber 55 and the interior end of housing segment 50. Spring 56 comprises a biasing means which applies biasing force on plate 54 urging diaphragm 52 in the second direction so as to attempt to reduce the volume of chamber 53. The spring plate 54 within chamber 53 includes an annular sealing edge 58 which in certain circumstances can cooperate with a resilient annular seat 60 mounted in the interior end surface of housing segment 48 and surrounding inlet 44, so as to prevent flow from chamber 53 into inlet 44.

The stabilizer 40 serves to maintain pressure within chamber 20 which is less than that at inlet 12 by the following mechanism. During flow of water through disconnector 10, the pressure in chamber 20 will be less than the pressure in inlet 12 by approximately the predetermined pressure differential level inherent in the design of check valve 16. This pressure differential is communicated to diaphragm 52, and causes diaphragm 52 to partially compress spring 56. When flow through disconnector 10 ceases, pressure within chambers 20 and 55 rise slightly to a level sufficient to close check valve 16, and which is substantially less than the pressure at inlet 12. At the time valve 16 closes, spring 56 will thus be compressed by an amount producing force equivalent to the force on diaphragm 52 arising from the pressure difference between inlet 12 and chamber 20 at that instant.

It can be seen that the stiffness of spring 56 and the pressure differential across valve 16 (which depends on spring 17) during flow determine the amount of displacement which the diaphragm 52 experiences. It is necessary that the stiffness or spring rate of spring 56 is chosen such that the pressure differential $P_{56}$ across diaphragm 52 which is just sufficient to totally compress spring 56 is greater than the pressure differential across diaphragm 26 which is just sufficient to open venting valve 22. At the same time, $P_{56}$ should not be significantly greater than the pressure differential at which the first check valve 16 opens. If these requirements for $P_{56}$ are satisfied, then after flow ceases in outlet 14, the pressure differential across diaphragm 52 will at all times balance the force provided by the compression of spring 56. When inlet 12 pressure drops, spring 56 reduces the pressure in chamber 20 to remain at $P_{56}$ below inlet pressure, preventing the pressure differential across diaphragm 26 from falling below that which holds valve 22 closed. Since the intermediate chamber 20 is tightly sealed by check valves 16 and 18, the pressure within the intermediate chamber 20 is not influenced by pressure variations on the input side 12. Even if inlet 12 pressure should drop to 0 bar, spring 56 will create suction within chamber 20 which is sufficient to hold valve 22 closed. This is because the pressure differential generated by spring 56 arises from the compression existing at the time that flow stopped, which is greater than the equivalent pressure differential produced by spring 24. This allows spring 56 to hold the pressure within chamber 20 to below 0 bar and therefore prevent spring 24 from opening valve 22.

Valve 22 can open to drain chamber 20 during a no flow situation only if one of the check valves 16 or 18 leaks. If check valve 18 leaks in the reverse flow direction because of check valve 18 malfunction as well as high back pressure from outlet 14, then air or water can enter chamber 20, allowing spring 56 to decompress, the pressure within chamber 20 to rise, and eventually the pressure differential across diaphragm 26 to fall to less than the equivalent pressure provided by spring 24. This is the common situation where contamination of the water supply can occur. Or if the pressure completely disappears from inlet 12 and then check valve 16 leaks in the forward direction, pressure can again increase within chamber 20 until the pressure differential across diaphragm 26 is insufficient to balance the force of spring 24. This latter situation essentially corresponds to the opening pressure of valve 16 falling to less than that necessary to open valve 22.

Figure 3:
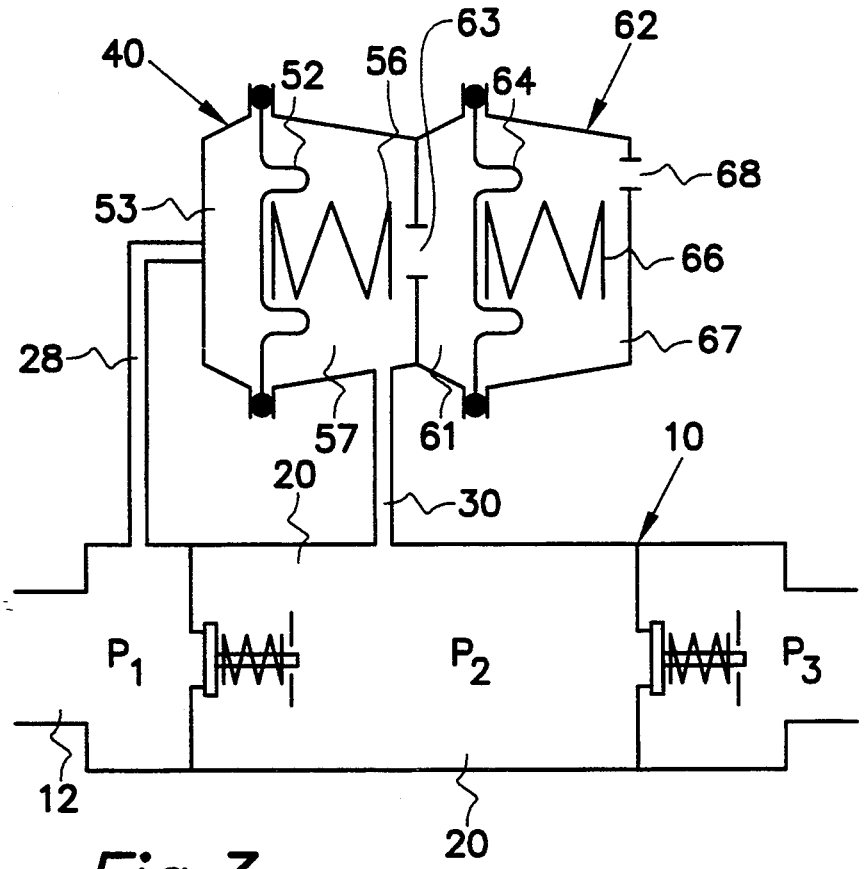
FIG. 3 shows a modification of the disconnector according to the invention.

FIG. 3 shows schematically the embodiment of the disconnector 10 as shown in FIG. 1, modified to further include a pressure limiter 62. One should assume that valve 22 and the diaphragm 26 and spring 24 which control it are present in this embodiment of FIG. 3 in the same form as shown in FIG. 1. This pressure limiter comprises a limiter housing including a limiter diaphragm 64 forming a movable limiter wall and together forming a first limiter chamber 61. The limiter housing is shown as attached to and forming a part of stabilizer 40, but may also have its own separate housing. In this embodiment, diaphragm 64 divides the enclosed space within the limiter housing into first and second limiter chambers 61 and 67. Diaphragm 64 is movable in first and second directions to respectively enlarge and shrink the first limiter chamber 61. The first limiter chamber 6 1 is in flow communication with the intermediate chamber 20 through aperture 63, second stabilizer chamber 57, and pipe 30. If limiter 62 is separated from stabilizer 40, then first limiter chamber 6 1 may have its own pipe for flow communication with intermediate chamber 20. The second limiter chamber 67 is vented to the atmosphere through vent 68 and contains a limiter bias means comprising a limiter spring 66 which is operatively connected to limiter diaphragm 64. Limiter spring 66 applies force to the diaphragm 64 urging the diaphragm 64 in the second direction so as to reduce the volume within first limiter chamber 61.

The spring rate of spring 66 is chosen so that hydrostatic pressure within chamber 20 above a predetermined level $P_{min}$ forces diaphragm 64 to move in the first direction to enlarge chamber 61 and completely compress spring 66. This predetermined pressure level $P_{min}$ is typically similar to the minimum pressure differential across diaphragm 26 in the intermediate chamber 20 which is sufficient to open valve 22. Since the pressure in intermediate chamber 20 (shown as $P_1$) is typically much higher than $P_{min}$, spring 66 will during normal operation be completely compressed. However, if inlet 12 pressure $P_1$ falls to a value below the sum of $P_{min}$ and the pressure drop sufficient to open valve 12, then pressure $P_2$ within chamber 20 will be maintained by pressure limiter 62 at near $P_{min}$. If inlet pressure $P_1$ falls to less than the sum of $P_{min}$ and the pressure differential across diaphragm 26 which allows valve 22 to open, then valve 22 will open. This provides a minimum inlet 12 pressure $P_1$ below which chamber 20 empties. Such an event might occur while the inlet pressure is removed for maintenance or by a malfunction of the water supply system. If at that time there is contaminated water downstream from a faulty check valve 18, then there is the potential for contaminated water to be introduced into the system were it not for the presence of intermediate chamber 20. At the same time, stabilizer 40 prevents draining of the intermediate chamber 20 when unneeded.

Figure 4:
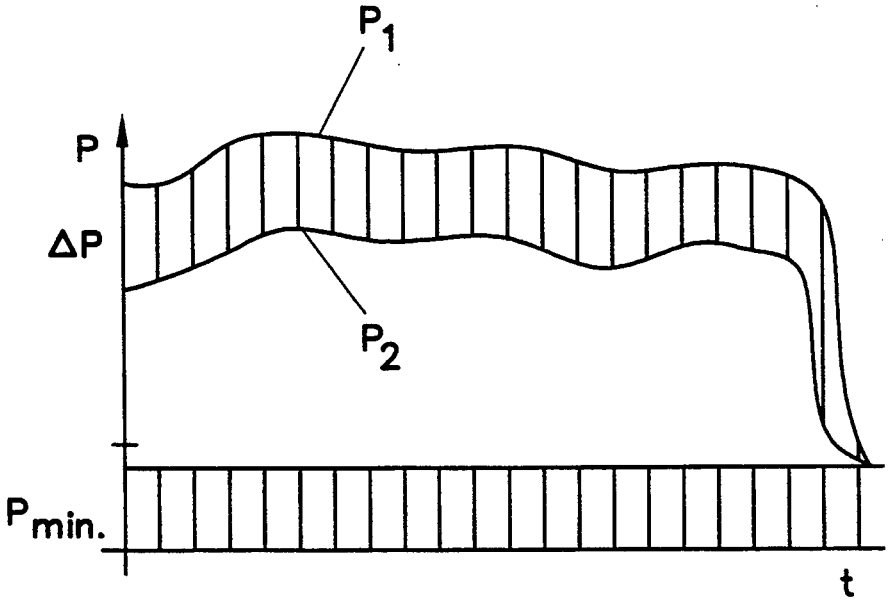
FIG. 4 is a diagram displaying the operation of the disconnector of FIG. 3.

This operation is illustrated graphically by FIG. 4 which shows the changes in pressures within the preventer of FIG. 3 over time. The pressures $P_1$ and $P_2$ are shown on FIG. 3 as located at the inlet 12 and within the intermediate chamber 20 respectively. One can see that normally, the differential pressure stabilizer 40 provides a constant differential pressure $\Delta p$ between the inlet 12 and the intermediate chamber 20. Should the static pressure $P_2$ within the intermediate chamber 20 fall below the predetermined minimum pressure $P_{min}$, the pressure limiter 62 becomes operative and maintains this minimum pressure within chamber 20. If $P_1$ falls to near $P_{min}$, then $P_1-P_2$ becomes less than p, which causes valve 22 to open and chamber 20 to drain.

The following claims the invention described above:

1. In a hydraulic disconnector having an input port and an output port, and comprising: a first check valve having an output port and an input port serving as the input port for the disconnector; a second check valve having an input port and an output port serving as the output port for the disconnector; an intermediate chamber connected between the output port of the first check valve and the input port of the second check valve; and a venting valve for venting the intermediate chamber to the atmosphere and controlled by the pressure differential between the input port of the disconnector and the intermediate chamber, the improvement comprising a differential pressure stabilizer connected between the input port of the disconnector and the intermediate chamber.

2. The disconnector of claim 1, wherein the differential pressure stabilizer comprises a housing enclosing first and second chambers separated by a stabilizer wall movable in first and second directions to respectively enlarge and shrink the first chamber and through which the first and second chambers are in pressure communication, said first and second chambers respectively in flow communication with the input port and the intermediate chamber.

3. The disconnector of claim 2, wherein the differential pressure stabilizer further includes a stabilizer bias means urging the stabilizer wall in the second direction.

4. The disconnector of claim 3, wherein the stabilizer bias means comprises a stabilizer spring.

5. The disconnector of claim 4, wherein the venting valve opens at a predetermined pressure differential between the input port and the intermediate chamber, and the stabilizer spring has a preselected spring rate creating a force on the stabilizer wall equivalent to a pressure differential greater than the predetermined pressure differential for the venting valve.

6. The disconnector of claim 5, wherein the first check valve has a predetermined operating pressure differential, and wherein the stabilizer spring has a preselected spring rate creating a force on the stabilizer wall equivalent to a pressure differential less than the predetermined operating pressure differential for the first check valve.

7. The disconnector of claim 3, wherein the stabilizer wall comprises a diaphragm.

8. The disconnector of claim 3, further comprising a pressure limiter for the intermediate chamber including a limiter housing including a limiter wall defining a limiter chamber, said limiter wall movable in first and second directions to respectively enlarge and shrink the limiter chamber, said limiter chamber in flow communication with the intermediate chamber, and limiter bias means operatively connected with limiter wall, for applying force to the limiter wall urging the limiter wall in the second direction.

9. The disconnector of claim 8, wherein the limiter bias means comprises a limiter spring.

10. The disconnector of claim 9, wherein the pressure limiter's second chamber is vented to atmospheric pressure.

11. The disconnector of claim 1, wherein the venting value includes means sensing the pressure differential between the input port and the intermediate chamber, for venting the intermediate chamber when said pressure differential falls below a predetermined pressure differential value, and wherein the differential pressure stabilizer includes means for holding the pressure in the intermediate chamber to less than the difference between the inlet pressure and the predetermined pressure differential value.

12. The disconnector of claim 11, wherein the differential pressure stabilizer comprises i) a housing enclosing first and second chambers separated by a first stabilizer wall movable in first and second directions to respectively enlarge and shrink the first chamber and through which the first and second chambers are in pressure communication, said first and second chambers respectively in flow communication with the input port and the intermediate chamber; and ii) a bias means in operative connection to the first stabilizer wall to apply force to the first stabilizer wall urging the first stabilizer wall in the second direction, said applied force forming the equivalent of a pressure differential across the first stabilizer wall greater than the predetermined pressure differential value.

13. The disconnector of claim 12, wherein the bias means is a spring.

* * * * *